US005511783A

United States Patent [19]

Popadiuk et al.

[11] Patent Number: 5,511,783

[45] Date of Patent: Apr. 30, 1996

[54] BALL MOMENTUM TRANSFER PLAY FEATURE FOR A PINBALL GAME

[75] Inventors: John A. Popadiuk; John W. Skalon, both of Chicago, Ill.

[73] Assignee: Williams Electronics Games, Inc., Chicago, Ill.

[21] Appl. No.: 463,929

[22] Filed: Jun. 5, 1995

[51] Int. Cl.[6] ..... A63F 7/30

[52] U.S. Cl. ..... 273/118 R; 273/127 R

[58] Field of Search ..... 273/118, 119, 273/121, 127 R, 127 B, 108; 434/300, 302; 446/4, 486, 168, 429

[56] References Cited

U.S. PATENT DOCUMENTS 4,968,035 11/1990 Furlong ..... 273/108 X 5,046,984 9/1991 Cane ..... 446/429 X 5,256,071 10/1993 Hones et al. ..... 446/486 X

*Primary Examiner*—Raleigh W. Chiu

*Attorney, Agent, or Firm*—Rockey, Rifkin and Ryther

[57] ABSTRACT

A pinball momentum transfer device or Newton ball device utilizes an impact bail anchored to the playfield. The impact ball, in cooperation with guide elements on the playfield, defines a ball travel area for captive balls to which momentum can be transferred from a game ball via the impact ball so as to project one of the captive balls towards a target element contained within the ball travel area.

4 Claims, 3 Drawing Sheets

BALL MOMENTUM TRANSFER PLAY FEATURE FOR A PINBALL GAME

BACKGROUND OF THE INVENTION

The invention relates to coin-operated amusement devices, especially rolling ball games, and specifically to an accessory for transferring momentum of a game ball to one or more other balls for amusement and scoring purposes.

Rolling ball games, such as pinball games, have been in existence for a number of years and typically comprise a game ball controlled by a player via flipper devices to interact with various playfield features. The features must present a challenge to the player, but must not be too difficult to activate or engage, otherwise player interest will be lost. One type of playfield feature, aptly termed a captured ball device, comprises one or more balls held captive between a pair of guide rails on the playfield. One of the captive balls is exposed to the playfield area such that when the player, using flipper elements, projects the game ball towards the exposed ball, the balls collide and momentum from the game ball is transferred through a line of captive balls to an end ball, projecting it towards a target. This device has been appropriately termed the Newton Ball device because it illustrates one of Newton's law of motion.

The general scheme of such prior art devices is illustrated in FIGS. 1, 2A, 2B and 2C. As can be seen from FIG. 1, the Newton Ball device is situated within a pinball cabinet 10 having a back box 12 which houses a display panel 14 for displaying the game score. Housed within the game cabinet 10 is an inclined playfield 16 which includes thereon a number of game features such as bumpers, targets and the like. The player activates flipper elements 18 to project the game ball towards the playfield features. Newton Ball device 20 is disposed on the playfield. While two captive balls are shown in the Figure, it is to be understood that any number of balls may be held captive in the Newton Ball device, so long as the uppermost ball is free to be projected towards the target.

Referring to FIGS. 2A, 2B, and 2C, guide assembly 40 is mounted on the playfield 16 and includes two rails 42 with guide edges 44 spaced apart at a distance slightly more than a ball diameter. Guide assembly 40 is raised above playfield 16 a distance approximating half a ball diameter on supports 28 such as those shown in FIG. 3, for example. A pair of bumper elements 46 are provided at the distal ends of the guide rails 42 and restrict the movement of impact ball A. Guide assembly 40 together with bumper elements 46 defines a captive ball travel area 50 wherein captive ball B may travel as it is projected towards target element 48. Impact ball A rests against the bumper elements 46 during play due to the incline of the playfield but is otherwise unrestrained from moving. Similarly, captive ball B rests against ball A. During play, the player, using flipper elements projects game ball C towards the impact ball A in order to engage it. When game ball C collides with impact ball A as shown in FIG. 2B, captive ball B is projected towards the target element 48 in the direction of arrow Y. During the collision with game ball C, ball A remains in place since all of the momentum of ball C is transferred to ball B; the net momentum transferred to ball A is effectively zero. FIG. 2C shows a target zone 60 which is a sector having angle θ. Target zone 60 defines the area of approach that the center of game ball C must occupy in order to collide with impact ball A.

In prior an devices, the target zone 60 is limited by bumper elements 46. If the center of game ball C does not approach ball A from the target zone, ball C will strike one of the bumper elements 46 instead of ball A and the device will not be activated. This wastes the player's flipper shot and reduces game action and appeal. Moreover, bumper elements 46 represent an increase in complexity and cost of the device as well as a hindrance to judgment of the player in determining the target area of ball A.

There is thus desired a device which has an increased target zone as compared to prior art devices and which is simple in design thereby resulting in decrease costs of manufacture and assembly.

It is accordingly an object of the present invention to provide an improved Newton Ball or momentum transfer device which has an increased target zone and therefore, increased game action and player appeal.

It is another object of the invention to provide a momentum transfer device with a reduced number of parts and simplified assembly and manufacture over prior art devices. These and other objects of the invention will be apparent from the remaining portion of the specification and drawings.

SUMMARY OF THE INVENTION

The present invention achieves the above objects by providing an impact element which has a 180° target zone exposed to collision with the game ball. The impact element also functions to constrain the captive balls within the ball travel area. The bumper elements of the prior art are thereby eliminated and the impact area is increased.

DETAILED DESCRIPTION OF THE PREFERRED EMBODIMENT

Figure 1:
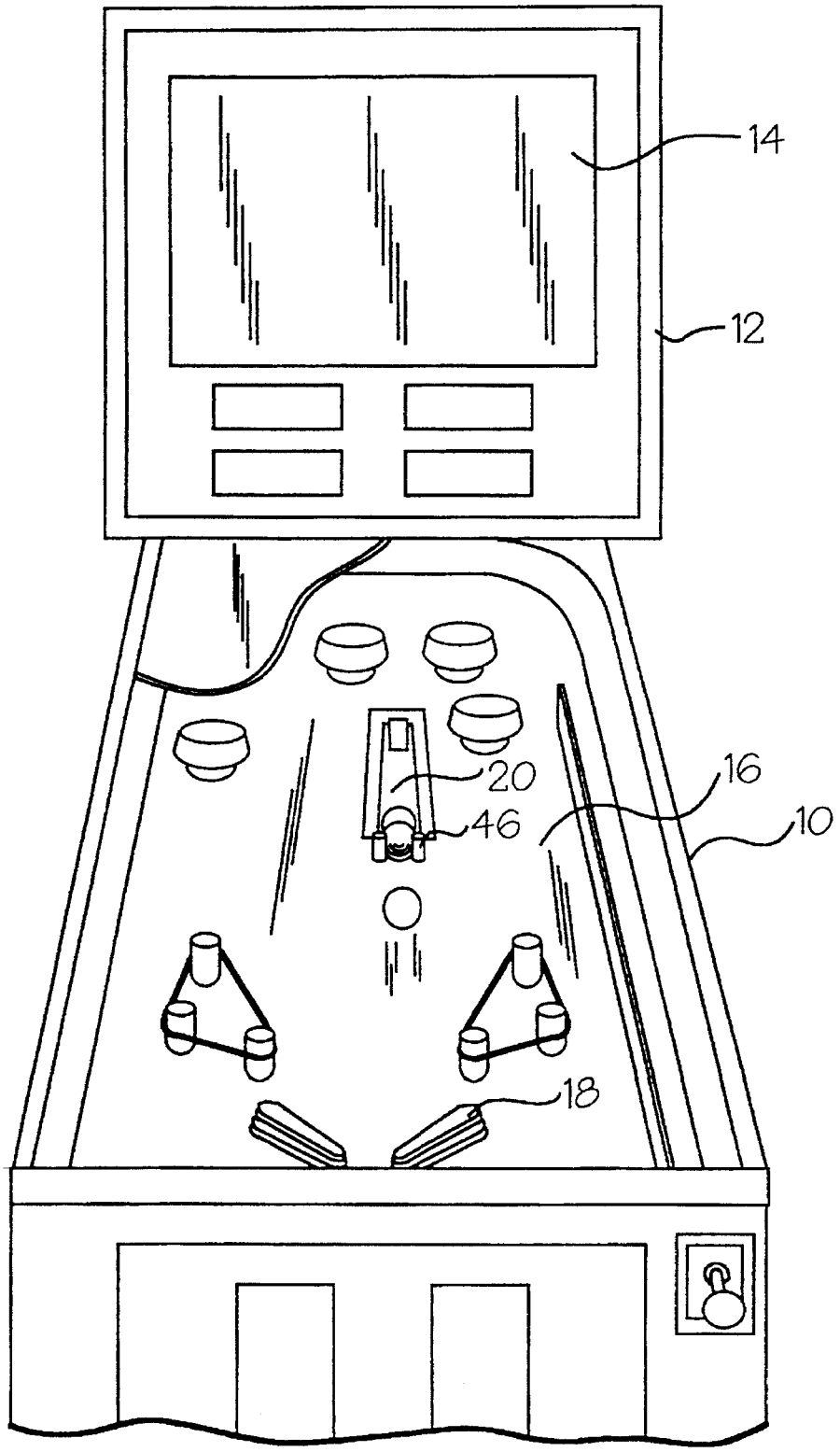
Fig. 1 Prior Art
FIG. 1 is a top view of a pinball playfield incorporating a momentum transfer device of the prior art as discussed above.
Figure 2A:
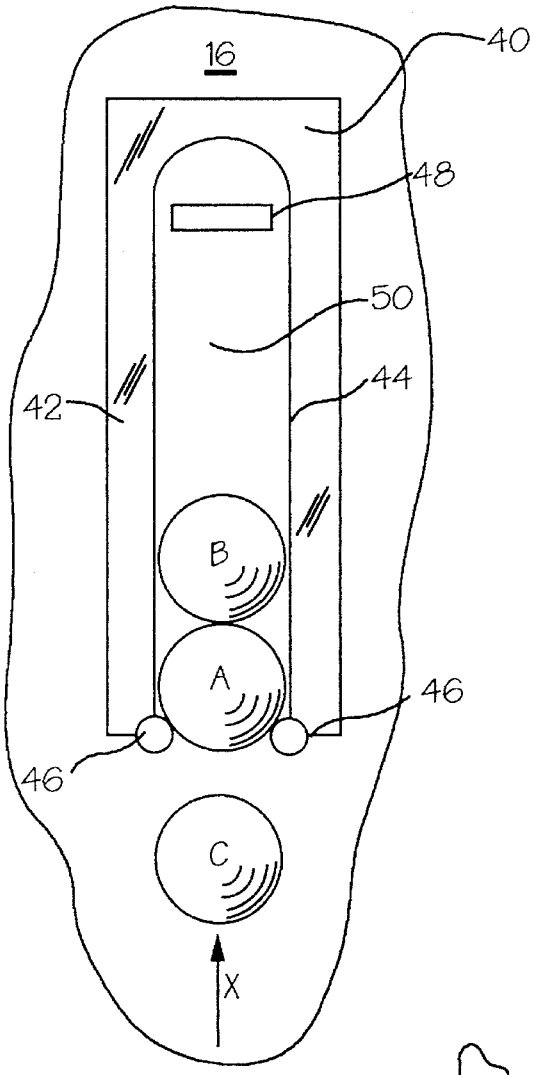
Fig. 2A Prior Art
FIG. 2A, 2B and 2C depict the operation of the prior art device as discussed above.
Figure 2B:
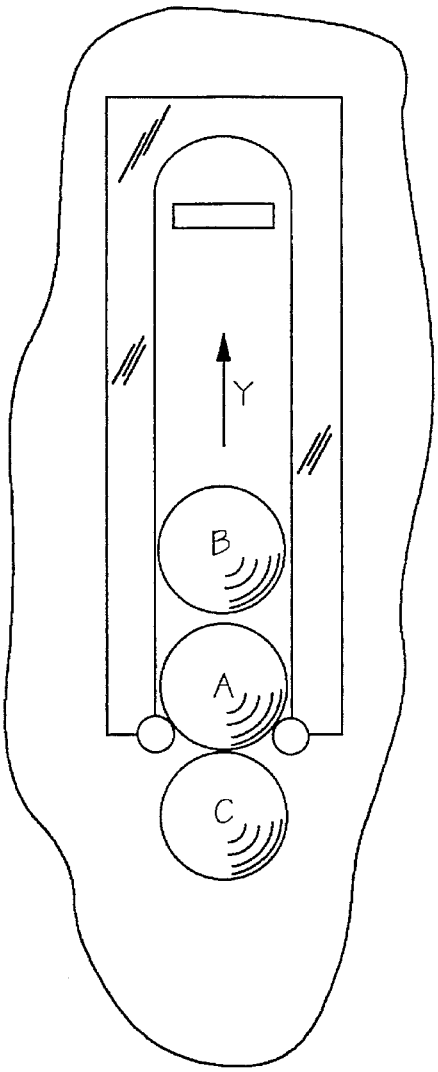
Fig. 2B Prior Art
Figure 2C:
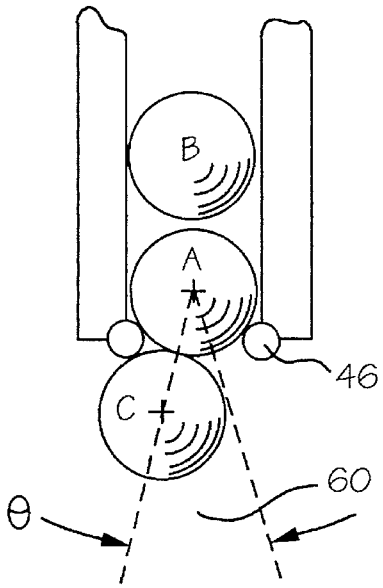
Fig. 2C Prior Art
Figure 3:
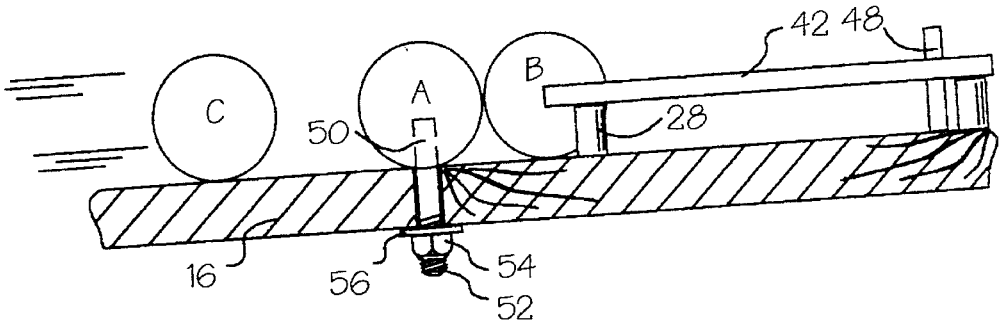
FIG. 3 is a side view of a preferred embodiment of the present invention.
Figure 4:
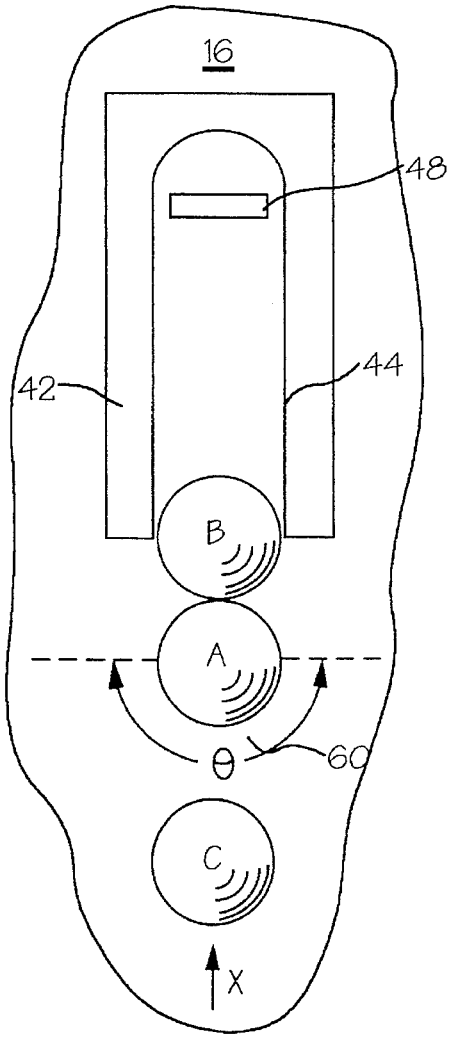
FIG. 4 is a plan view of a preferred embodiment of the present invention.

FIG. 3 shows a side view of a preferred embodiment of the present invention. An impact ball A is drilled and anchored to the pinball playfield 16 by means of a fastener 51 which is affixed to the impact element A, extends downwardly into the playfield 16, and is secured with a washer 56 and a nut 54 using threads 52 on end of 51. A top view of the device is shown in FIG. 4. Because impact ball A is anchored to the playfield, the bumper elements of the prior art are not necessary to restrict movement of captive rolling ball B. The length of the guide rails 44 may be limited to that just required to hold ball B captive within the ball travel area against element A. As can be seen from FIG. 4, because of the elimination of the bumper elements of the prior art, the exposed target zone 60 of impact ball A is increased to 180°. Game ball C may approach impact ball A from anywhere within the increased target zone and still impart at least a portion of its momentum to the captive ball B.

Impact element A may be anchored by any conventional means and not necessarily to the playfield itself, but alternatively, may be fastened to the guide element or guide assembly 40 so that the guide assembly and impact ball may be installed as a single unit. Although the impact element is shown as having a shape identical to a pinball, it is to be understood that the impact element may be any shape and made of any material which permits the function of transferring the momentum of the game ball to the captive ball or balls.

From the foregoing, it will be seen that a very versatile playfield accessory has been disclosed which can increase player appeal and interest and which reduces the complexity of the momentum transfer devices of the prior art. While preferred embodiments of the present invention have been illustrated and described, it will be understood by those of ordinary skill in the art that changes and modifications can be made without departing from the invention as defined in the claims that follow.

What is claimed is:

1. In combination: a rolling ball game including an inclined playfield and a momentum play feature comprising:

(a) an inclined playfield;

(b) a guide assembly having two rails defining a captive ball travel area on said playfield;

(c) at least one captive ball disposed within said travel area;

(d) an impact element secured to the playfield, adjacent said captive ball travel area, for transferring momentum from said game ball to said at least one captive ball; and one of said captive balls rests against said impact element during game play to receive momentum when said game ball strikes said impact element.

2. The combination of claim 1, wherein said impact element comprises a ball drilled and threadingly secured to said playfield.

3. The combination of claim 1, wherein said impact element comprises a pinball secured to said playfield.

4. The combination of claim 1, further including a target disposed within said travel area intended to be struck by one of said captive drills to score points.

* * * * *